United States Patent [19]

Kolb

[11] Patent Number: 4,781,411

[45] Date of Patent: Nov. 1, 1988

[54] PORTABLE SUN SHIELD

[76] Inventor: James A. Kolb, 2535 McArthur St., Lakeland, Fla. 33801

[21] Appl. No.: 41,691

[22] Filed: Apr. 23, 1987

[51] Int. Cl.[4] ..... A47C 7/66

[52] U.S. Cl. ..... 297/184; 248/289.1; 248/397; 248/521; 297/191

[58] Field of Search ..... 297/184, 191; 248/289.1, 371, 397, 418, 521; 403/84, 378, 379

[56] References Cited

U.S. PATENT DOCUMENTS

| | | | |
|---|---|---|---|
| 2,512,806 | 6/1950 | Neiborn | 297/184 X |
| 2,561,886 | 7/1951 | Rikelman | 297/184 X |
| 2,618,285 | 11/1952 | Heisig | 403/378 X |
| 3,275,283 | 9/1966 | Rauch | 297/349 X |
| 3,304,035 | 2/1967 | Davis | 403/378 X |
| 4,100,633 | 7/1978 | Pintos | 297/184 X |
| 4,293,162 | 10/1981 | Pap et al. | 297/184 |
| 4,645,167 | 2/1987 | Hardwick | 297/184 X |

FOREIGN PATENT DOCUMENTS

| | | | |
|---|---|---|---|
| 2322565 | 5/1977 | France | 297/184 |

*Primary Examiner*—Kenneth J. Dorner
*Assistant Examiner*—Peter R. Brown
*Attorney, Agent, or Firm*—Leon Gilden

[57] ABSTRACT

A portable sun shield is constructed from lightweight aluminum or PVC piping and is quickly attachable to a bracket assembly attached to the back of a fisherman's chair or the like. Several different bracket assemblies are utilized to hold the shield over the chair, and the shield can also be utilized as a sail for a boat in an emergency situation.

6 Claims, 6 Drawing Sheets

PORTABLE SUN SHIELD

BACKGROUND OF THE INVENTION

1. Field of the Invention

The present invention relates to sun shields, and more particularly pertains to a new and improved portable sun shield which is specially designed for attachment over a fisherman's chair in a boat.

2. Description of the Prior Art

The use of umbrellas, sun visors, and other shading devices which are attached to chairs is well known in the prior art. Where shading is to be provided for chairs permanently attached to the decks of boats, however, the usual practice is to provide a foldable canopy arrangement which substantially covers a large area of the boat, to include chairs contained therein. Unfortunately, these canopies can interfere with a fisherman who is casting and accordingly, it usually becomes necessary to collapse the canopy when this type of fishing is undertaken. As such, a conventional canopy becomes substantially useless for providing shade when a fisherman sitting in a boat chair desires to cast for fish.

Apparently, there are no commercially available sun shades or screens which are specially designed for attachment to a fisherman's chair wherein such shades would allow the fisherman to be protected from the sun while also permitting him to utilize casting as his method of fishing. Therefore, it would appear that a need exists for this type of shading device and in this respect, the present invention substantially fulfills this need.

SUMMARY OF THE INVENTION

In view of the foregoing disadvantages inherent in the known types of sun shields and screens now present in the prior art, the present invention provides an improved sun shield of a portable and lightweight construction wherein the same is specially designed for attachment to the back of a fisherman's chair in a boat. As such, the general purpose of the present invention, which will be described subsequently in greater detail, is to provide a new and improved portable sun shield which has all the advantages of the prior art sun shields and none of the disadvantages.

To attain this, the present invention essentially comprises a tubular framework manufactured from PVC or aluminum tubing to which a vinyl, cloth or canvas cover can be snap-fitted. The cover holding framework includes one downwardly extending tubular member with this tubular member being attachable to one of several different types of bracket assemblies fixedly securable to a rear portion of a fisherman's seat in a boat. The cover assembly may be rotated to different angles, and it can be collapsed into a stored position when desired. Additionally, the cover assembly is of an elongated and narrow shape so as to provide the necessary sun shading function for the fisherman while not interfering with his ability to cast with his rod.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Pat. and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved portable sun shield which has all the advantages of the prior art portable sun shields and none of the disadvantages.

It is another object of the present invention to provide a new and improved portable sun shield which may be easily and efficiently manufactured and marketed.

It is a further object of the present invention to provide a new and improved portable sun shield which is of a durable and reliable construction.

An even further object of the present invention is to provide a new and improved portable sun shield which is susceptible of a low cost of manufacture with regard to both materials and labor, and which accordingly is then susceptible of low prices of sale to the consuming public, thereby making such portable sun shields economically available to the buying public.

Still yet another object of the present invention is to provide a new and improved portable sun shield which provides in the apparatuses and methods of the prior art some of the advantages thereof, while simultaneously overcoming some of the disadvantages normally associated therewith.

Still another object of the present invention is to provide a new and improved portable sun shield which is specially designed for attachment to a fisherman's chair in a boat.

Yet another object of the present invention is to provide a new and improved portable sun shield which provides shade for a fisherman while not interfering with his ability to cast a fishing rod.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEP DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENTS

Figure 1:
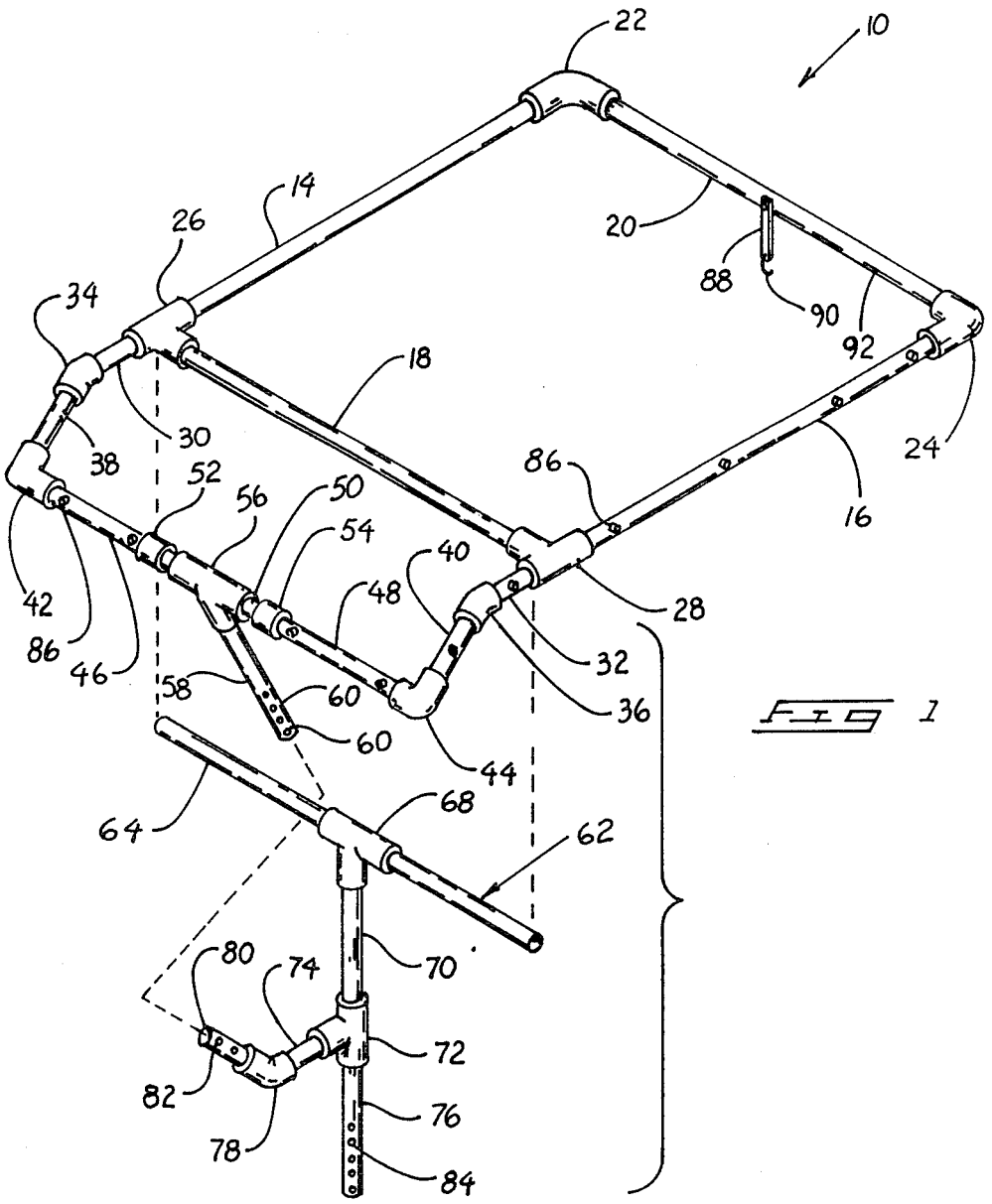
FIG. 1 is a perspective view of the cover support assembly comprising a part of the present invention.

With reference now to the drawings, and in particular to FIG. 1 thereof, a new and improved portable sun shield embodying the principles and concepts of the present invention and generally designated by the reference numeral 10 will be described.

More specifically, it will be noted that the sun shield 10 includes a cover support frame 12 essentially formed from a plurality of lightweight PVC or aluminum conduit members and fittings. The frame 12 includes paralleledly aligned tubing members 14, 16 which are interconnected by paralleledly aligned tubing members 18, 20. An elbow fitting 22 is utilized to connect the member 14 to the member 20, and a similar elbow fitting 24 connects the member 20 to the tubing member 16. A tee fitting 26 is utilized to connect the member 14 to the member 18, and a similar tee fitting 28 connects the conduit 16 to the conduit 18.

A further pair of paralleledly aligned tubing members 30, 32 are respectively connected to the tee fittings 26, 28 and 45 degree elbow fittings 34, 36 are respectively attached to the free ends thereof. Paralleledly aligned tubing members 38, 40 extend downwardly from the respective elbow fittings 34, 36 with their free ends having elbow fittings 42, 44 fixedly secured thereto. Axially aligned tubing members 46, 48 are attached to the respective elbow fittings 42, 44. A further length of tubing 50 is interconnected between the axially aligned tubing members 46, 48 by a pair of conventional sleeves 52, 54. A tee fitting 56 having an internal diameter greater than the external diameter of the conduit 50 is rotatably mounted over the conduit. A further length of tubing 58 extends downwardly from the tee fitting 56 with this further length of tubing being provided with a plurality of through-extending apertures 60.

FIG. 1 further illustrates a cover frame support member 62 designed to hold the cover support frame 12 over a fisherman's chair. The cover frame support member 62 includes first and second axially aligned tubing members 64, 66 which are connected together by a tee fitting 68, and a downwardly extending tubing member 70 connected to the sane tee fitting. A further tee fitting 72 is rotatably attached to the tubing member 70 and also has tubing members 74, 76 fixedly secured thereto. A 45 degree elbow fitting 78 is attached to the free end of the tubing member 74, and a further tubing member 80 extends outwardly from the fitting 78, with this further tubing member having a plurality of through-extending apertures 82 therein. A further plurality of through-extending apertures 84 are provided in spaced alignment on the free end of the tubing member 76.

The cover frame support member 62 is designed to be permanently attached to the cover support frame 12. In this regard, the aligned tubing member 64, 66 forming a part of the cover frame support member 62 have a greater internal diameter than the external diameter of the tubing member 18 forming a part of the cover support frame 12. At the time of assembly of the cover support frame 12, the tubing member 18 will be permanently positionpd and retained within the tubing members 64, 66 so as to effect a rotatable interconnection between the cover support frame and the cover frame support members 62. When so assembled, the cover support frame 12 maybe rotated upwardly or downwardly with respect to the position of the cover frame support member 62 and when a desired angle is achieved, the cover support frame 12 may be locked in position. This locking function is accomplished by fixedly securing the tubing members 58, 80 together.

In this respect, the tubing member 58 has a smaller external diameter than the internal diameter of the tubing member 80, thereby to allow the member 58 to be inserted into the member 80. When the cover support frame 12 is positioned at the desired angle of tilt, an unillustrated locking pin may be directed through selectively aligned apertures 82, 60 to hold the cover support frame is position. As illustrated, a plurality of snaps 86 are positioned around the periphery of the cover support frame 12 with these snaps allowing the attachment of a rectangularly shaped vinyl, cloth or canvas cover over the support frame. An elastic strap 88 may be permanently affixed to the tubing member 20. The strap 88 is provided with a hook member 90 that is selectively engagable with an aperture 92 formed in the tubing member 20. The elastic strap 88 serves as a tiedown when the cover support frame 12 is in a collapsed position against a fisherman's chair.

Figure 2:
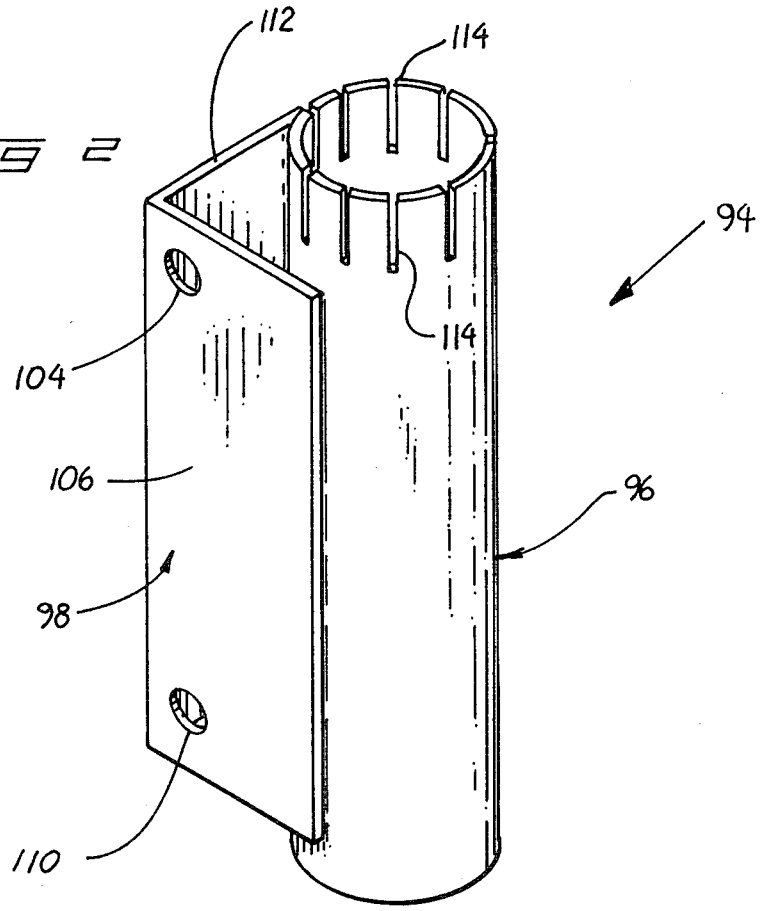
FIG. 2 is a perspective view of a modified connector utilizable to hold the cover assembly.
Figure 3:
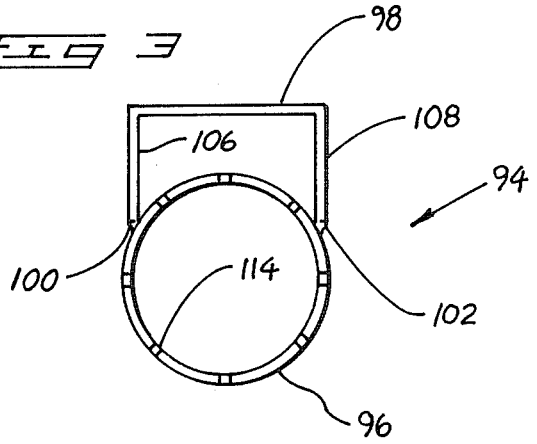
FIG. 3 is a top plan view of the connector.

FIGS. 2 and 3 illustrate a connector 94 which is utilized to connect the cover frame support member 62 to a bracket assembly which will be subsequently described and which is fixedly secured to the back of a fisherman's chair. The connector assembly 94 includes a length of tubing 96 and a channel member 98 which is fixedly secured to the tubing member in an axially aligned relationship. In this regard, the channel member 98 may be secured to the tubing member 96 along its respective edges 100,102 by some conventional means, such as through the use of welding, adhesives, or the like. The channel member 98 extends only partially around the tubing member 96 and includes a first aperture 104 which extends through both of the sidewalls 106, 108 forming a part of the channel member. A second aperture 110 is positioned at a bottommost portion of the channel member 98 and extends through both of the sidewalls 106, 108. The tubing member 96 extends upwardly beyond a top edge 112 of the channel member 98, and a plurality of slots 114 are formed in the top of the tubing member. As illustrated, pairs of these slots 114 are positioned in an opposed relationship along diameters defining the curvature of the tubing member 96, and such slots are sized to receive a locking pin which is concurrently positioned through the apertures 84 formed in the tubing member 76 comprising a part of the cover frame support member 62.

Figure 4:
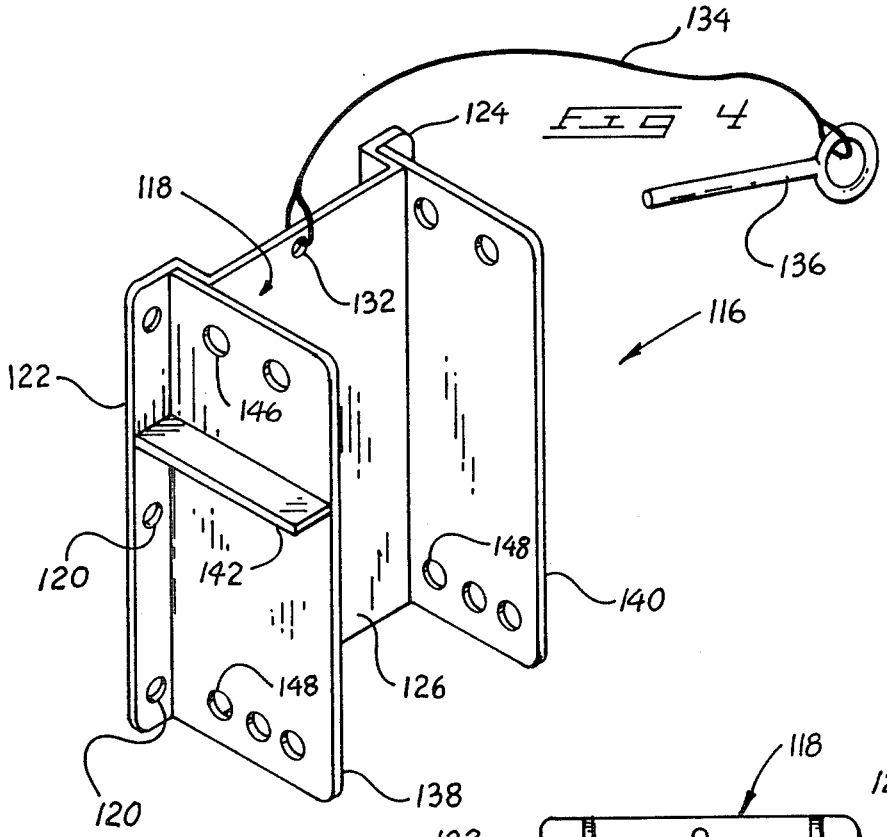
FIG. 4 is a perspective view of a first bracket for holding the cover assembly over a chair.
Figure 5:
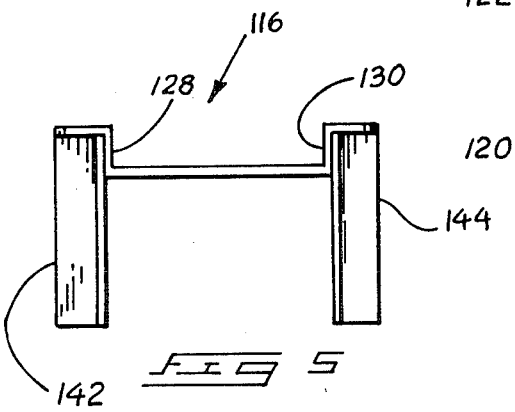
FIG. 5 is a top plan view of the first bracket.
Figure 6:
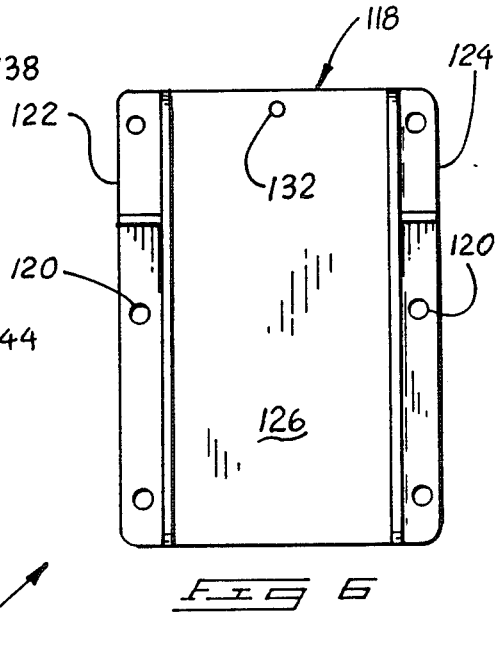
FIG. 6 is a front elevation view of the first bracket.

FIGS. 4, 5 and 6 illustrate a first bracket assembly 116 which may be permanently attached to a back portion of a fisherman's chair. The bracket 116 includes a first plate member 118, preferably of a metallic construction, and having a plurality of apertures 120 along respective flange portions 122, 124. The through-extending apertures 120 facilitate the use of threaded fasteners for permanently attaching the plate member 118 to a rear portion of a chair. An intermediate portion 126 of the plate member 118 is of a inwardly stepped construction so as to define a pair of aligned sidewalls 128, 130, and a throughextending aperture 132 formed in a top portion of this intermediate section is designed to retain a lanyard 134 to which a retaining pin 136 is fixedly secured.

A pair of plate members 138, 140 are paralleledly aligned and fixedly secured by some conventional means to the respective sidewalls 128, 130. A pair of stiffeners 142, 144 may be fixedly secured between the respective plate members 138, 140 and the respective-flanges 122, 124. A plurality of throughextending apertures 146 are in axial alignment between the plate members 138, 140 along topmost edges thereof. Similarly, a further plurality of through-extending apertures 148 are positioned in axial alignment between the plate members 138, 140 along bottom edge portions thereof.

As to the manner of usage and operation of this first embodiment of the invention, it can be appreciated that the bracket assembly 116 is fixedly, permanently secured to a rear portion of a fisherman's chair, and the connector assembly 94 is then positionable between the plate members 138, 140. The through-extending aperture 110 formed in the connector 94 is selectively alignable with one of the aligned aperture arrangements 148 formed in the bracket assembly 116, and an unillustrated bolt may then be directed through these aligned apertures 110, 148 to effect a securement of the connector to the bracket. As is apparent, depending upon which set of apertures 148 are aligned with the aperture 110, the angle of the connector 94 can be selectively controlled. Further angle adjustment is afforded by the use of a further bolt which is directed through selected aligned apertures 146, 104.

When the connector 94 has been aligned as desired and fixedly secured to the bracket assembly 116, the conduit 76 is positioned downwardly within the tubular member 96 until a desired height of the cover support frame 12 over the chair is achieved. The pin 136 is then directed through a first slot 114, then through a selected aperture 84 formed in the tubing member 76, and outwardly through a second aligned slot 114. Depending upon the number of chosen slots 114 around the periphery of the tubing member 96, rotatable adjustment of the cover support frame 12 is afforded in a rapid and easy manner. In this respect, a user need only to lift upwardly on the cover frame support member 62, so as to temporarily disengage the pin 136 from a pair of slots 114. The cover support frame 12 may then be manually rotated to a desired position where the pin is again aligned with a pair of slots 114, and a lowering of the cover frame support member 62 then fixedly secures the frame in its new chosen rotated position.

Figure 7:
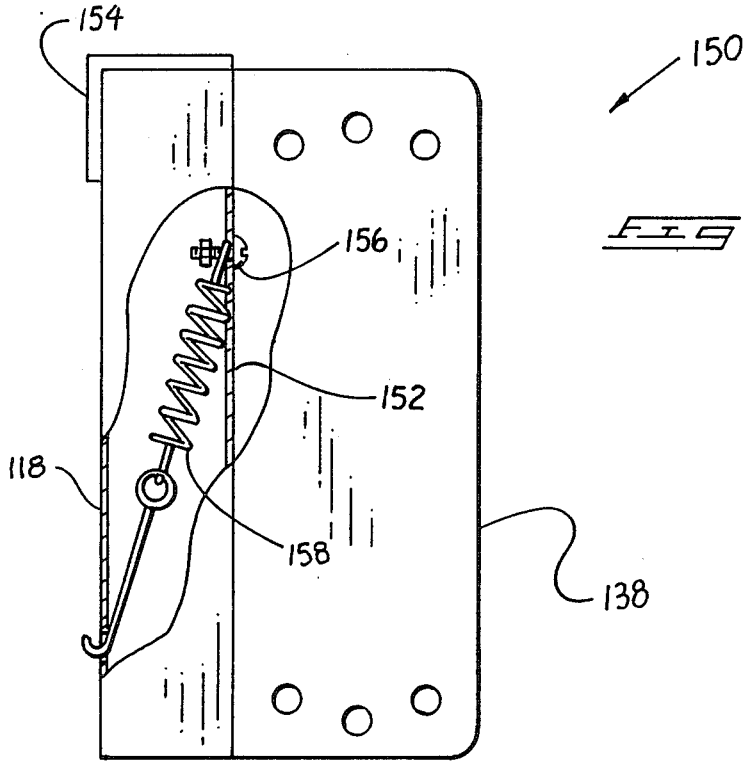
FIG. 7 is a side elevation view of a second bracket assembly utilized for holding the cover.
Figure 8:
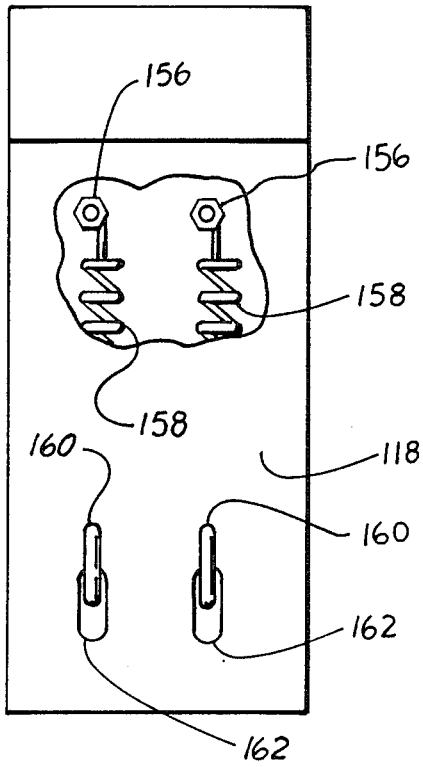
FIG. 8 is a rear elevation view of the second bracket assembly.

FIGS. 7 and 8 illustrate a modified bracket assembly generally designated by the reference numeral 150. The modified bracket assembly 150 is substantially similar to the bracket assembly 116 shown in FIG. 4. However, with reference to FIG. 4 in conjunction with FIGS. 7 and 8, only the plate member 118 is permanently attached to a rear portion of a fisherman's chair. The plates 138, 140 are fixedly secured together by an intermediate plate member 152 with this intermediate plate member having a hooked flange portion 154 designed to overlap and grip the intermediate portion 126 forming a part of the plate member 118. Additionally, the intermediate plate member 152 is provided with a pair of through-extending threaded connectors 156, and a pair of helical springs 158 are fixedly secured to these connectors. Hooks 160 are attached to bottom portions of the springs 158 and are designed to engage a pair of slots 162 now provided in the plate member 118. The connector 94 is attachable to the bracket assembly 116 in precisely the same manner as described with respect to the embodiment of the bracket shown in FIGS. 4, 5 and 6. However, when not being utilized, the plates 138, 140, which are fixedly secured together by the plate member 152, can now be completely removed from the rear portion of the chair, thereby leaving only a small and inconspicuous plate member 118.

Figure 9:
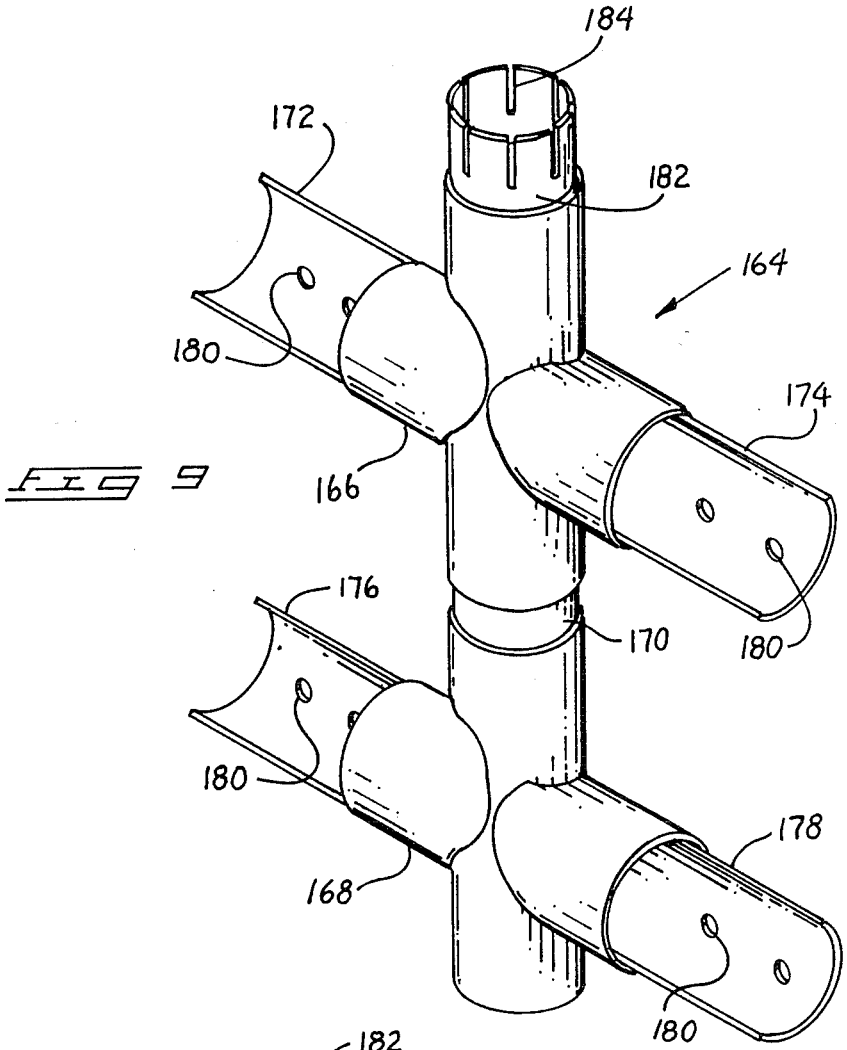
FIG. 9 is a perspective view of a third bracket assembly for holding the cover over a chair.
Figure 10:
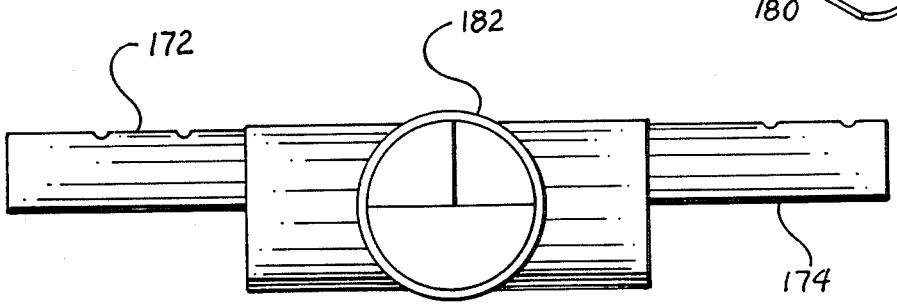
FIG. 10 is a top plan view of the third bracket assembly.

FIGS. 9 and 10 illustrate a further bracket holding assembly of a modified construction with this further bracket assembly being generally designated by the reference numeral 164. In this respect, the bracket assembly 164 is constructed completely of PVC piping and includes the use of first and second cross tees 166, 168 connected together by a length of tubing 170. Sections of PVC tubing 172, 174 which have been split along axial lengths thereof are fixedly secured in axial alignment within the cross tee member 166. Similarly, split tubing sections 176, 178 are similarly fixedly secured in axial alignment within the cross tee member 168. A plurality of through-extending apertures 180 are then drilled through the split tubing sections 172, 174, 176, 178, and a final section of tubing 182 is fixedly secured in a topmost portion of the cross tee member 176. A plurality of slots 184 are cut in opposed alignment along diameter portions of the tubing member 182, with these slots 184 functioning precisely in the same manner of the slots 114 forming a part of the aforedescribed connector 94. As is now apparent, the bracket assembly 164 may be permanently attached to a rear portion of a fisherman's chair through the use of threaded fasteners directed through the apertures 180, and the cover frame support member 62 may have its bottom tubing member 76 then positioned within the tubing section 182. A pin 136 can then be concurrently directed through the slots 184 and a selected aperture 84 formed in the tubing member 76, thus to hold the cover support frame 12 and its attached cover over the fisherman's chair in a desired position.

Figure 15:
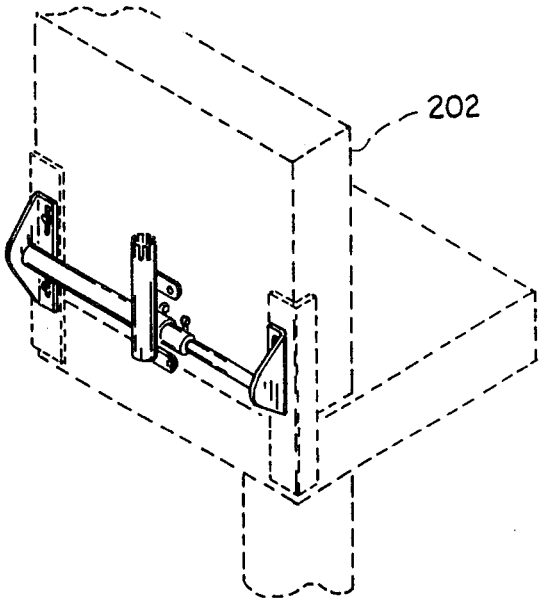
FIG. 15 is a perspective view illustrating the fourth bracket assembly operably attached to a fisherman's chair.
Figure 11:
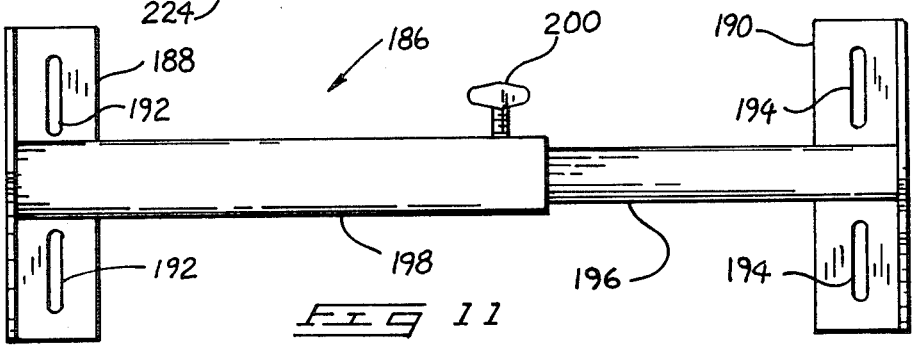
FIG. 11 is a front elevation view of a fourth bracket assembly utilizable for holding the cover over a chair.
Figure 12:
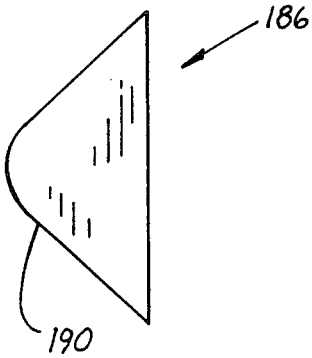
FIG. 12 is a side elevation view of the fourth bracket assembly.

FIGS. 11 and 12 illustrate a modified bracket assembly 186 which is designed for utilizing existing threaded fasteners and apertures formed in the factory provided hinge comprising a part of a fisherman's chair. As illustrated, the assembly 186 includes a pair of bracket plates 188, 190 having respective elongated slots 192, 194 through which threaded fasteners may be directed. Lengthwise width adjustment of the bracket assembly 186 is afforded by a telescoping tubing arrangement. In this regard, the bracket member 190 has a first length of tubing 196 orthogonally fixedly secured thereto, and the bracket member 188 has a second length of tubing 198 similarly orthogonally fixedly attached thereto. As illustrated, the tubing member 196 is telescopingly received within an interior diameter portion of the tubing member 198, and a thumb screw 200 is provided for fixedly securing the two tubing members together when the desired width adjustment is achieved. As shown in FIG. 15, the bracket assembly 186 should be adjusted in width to a position where the slots 192, 194 are aligned with factory-provided threaded fasteners forming a part of a fisherman's chair 202.

Figure 13:
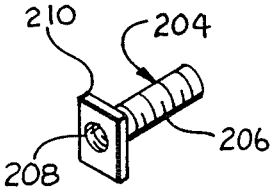
FIG. 13 is a perspective view of a special screw utilizable to attach the fourth bracket assembly to a chair.

To facilitate the attachment of the bracket assembly 186 to a chair 202 in a rapid and efficient manner, and to also provide a means for quickly removing the bracket assembly from a chair, a special threaded fastener 204, as illustrated in Figure 13, can be utilized. In this respect, each fastener 204 is provided with exterior male threads 206 which allow them to replace factory screws attached to a chair 202. Additionally, each fastener 204 includes internal female threads 208 in a head portion 210 thereof, with these internal threads 208 being designed to receive a conventional thumb screw fastener. As such, the fasteners 204 can be permanently installed in a chair 202, and thumb screws can then be utilized to attach the bracket assembly 186, when desired, to the back of the chair 202 and of course, a rapid and efficient removal of the bracket assembly is achieved by a simple removal of the associated thumb screws.

Figure 14:
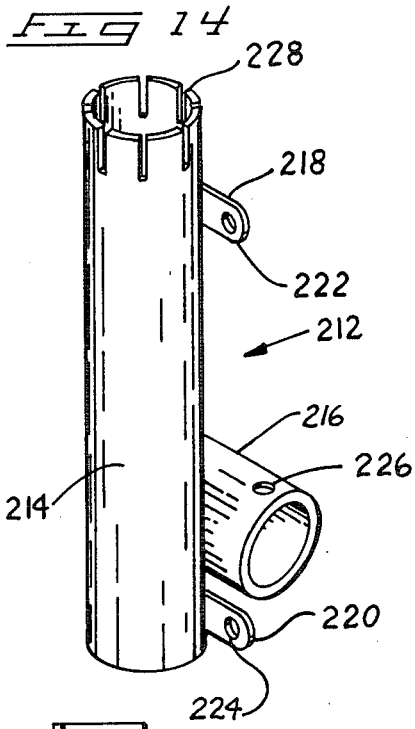
FIG. 14 is a perspective view of a modified connector arrangement for holding the cover assembly.

FIGS. 14 and 15 illustrate a modified connector for connecting the sun shield 10 to the bracket assembly 186. The connector 212 includes a first tubing member 214 and a section of orthogonally aligned tubing 216 fixedly secured thereto. Additionally, a pair of alignment plates 218, 220 are fixedly secured to the tubing member 214 in the manner illustrated, and these plates are provided with respective through-extending threaded apertures 222, 224. By the same token, a threaded aperture 226 is directed through a top portion of the tubing member 216.

With particular reference to FIG. 15, it will be noted that the tubing member 216 has a larger internal diameter than the external diameter of the tubing member 198, whereby the connector 212 may be slidably disposed over the tubing member 198. A thumb screw positioned in the aperture 226 allows the connector 212 to be fixedly secured in a desired position along the tubing member 198. By the same token, angular adjustment of the connector 212 is achieved by providing thumb screws in the apertures 222, 224. The unillustrated thumb screws would include swivel plates on bottom portions thereof so that they can be directed against the back of a chair 202 without penetrating the chair's surface. As such, by threadably moving the thumb screws inwardly and outwardly within the apertures 222, 224, a desired angle of tilt for the connector 212 is achieved. Of course, the top of the tubing member 214 is provided with a plurality of aligned slots 228 which are substantially similar to and function in the same manner as the slots 114 as aforedescribed. Accordingly, the manner of usage and operation of this final embodiment of bracket assembly 186 is apparent from the above description, and no further discussion relative thereto will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A new and improved portable sun shield selectively attachable to a separate structure, such shield comprising:

cover frame means having a cover selectively attachable thereto;

cover frame support means for supporting said cover frame means;

bracket assembly means fixedly securable to said separate structure;

and connector means operably attachable to said bracket assembly means, said connector means serving to receive and retain said cover frame support means in a selected fixed position, and said cover frame means comprising a first planar section including a forward link, a plurality of parallel side links, and a rear cylinderical pivot link of a first diameter; said cover frame means further including a second section including a plurality of second side links angulated downwardly with respect to said side links, and a connecting link rearwardly and parallel said forward link and said rear cylindrical pivot link and underlying a plane defined by said first planar section; said connecting link having secured thereto a first locking means for securing said cover frame means in a selected angular position relative to said cover frame support means, and said cover frame support means including a top hollow sylinderical support means of a second diameter arranged for accepting said rear cylinderical pivot link therein for rotatably securing said cover frame means to said cover frame support means.

2. The new and improved portable sun shield selectively attachable to a separate structure as described in claim 1, and further including second locking means for preventing relative rotation between said cover frame support means and said connector means.

3. The new and improved portable sun shield selectively attachable to a separate structure as described in claim 2, wherein said second locking means comprises slots formed in said connector means, said slots serving to receive a pin directed therebetween, said pin being concurrently directed through one of a plurality of apertures formed in said cover frame support means.

4. The new and improved portable sun shield selectively attachable to a seperate structure as described in claim 3, wherein said first locking means is rotatably attached to said cover frame means.

5. The new and improved portable sun shield selectively attachable to a separate structure as described in claim 4, and further including third locking means for controlling an angular positioning of said connector means with respect to said bracket assembly means.

6. The new and improved portable sun shield selectively attachable to a separate structure as described in claim 5, wherein said separate structure comprises a fisherman's chair positioned within a boat.

* * * * *